United States Patent [19]

Gabbay et al.

[11] Patent Number: 4,472,827

[45] Date of Patent: Sep. 18, 1984

[54] UNIVERSAL LIMITER FOR LIMITING SECONDARY RADIATION IN AN X-RAY TUBE PROVIDED WITH SAID LIMITER

[75] Inventors: Emile Gabbay; Jean M. Penato, both of Paris, France

[73] Assignee: Thomson CSF, Paris, France

[21] Appl. No.: 337,615

[22] Filed: Jan. 7, 1982

[30] Foreign Application Priority Data

Jan. 16, 1981 [FR] France ..... 81 00775

[51] Int. Cl.[3] ..... H01J 35/00

[52] U.S. Cl. ..... 378/140; 378/147

[58] Field of Search ..... 378/140, 147

[56] References Cited

U.S. PATENT DOCUMENTS 4,309,637 1/1982 Fetter ..... 378/140

*Primary Examiner*—Craig E. Church

*Attorney, Agent, or Firm*—Roland Plottel

[57] ABSTRACT

A universal limiter for any type of x-ray tube used in radiology or radiation therapy comprises an envelope of conical shape whose axis coincides with the axis of symmetry of the useful beam of radiation. The limiter is formed of material which is opaque to secondary radiation. The inlet aperture of the limiter is located in the immediate vicinity of the emitting focal spot and the outlet aperture of the limiter is connected mechanically to the exit window of the x-ray tube.

9 Claims, 3 Drawing Figures

UNIVERSAL LIMITER FOR LIMITING SECONDARY RADIATION IN AN X-RAY TUBE PROVIDED WITH SAID LIMITER

This invention relates to a universal limiter of secondary radiation in an x-ray tube and finds an application both in the field of conventional radiology and in the field of radiation therapy.

When a suitable target is bombarded with a stream of fast electrons, it emits a given photon flux within a spectral band which is related to the nature and geometry of the target as well as to the velocity of the electrons. Generating devices of this type are known as x-ray tubes and emit more particularly within the x-ray or $\gamma$-ray band. It is also possible to utilize secondary photon emissions. In all cases, the radiation-emissive zone is designated as the focal spot.

In the geometrical distribution of the stream of generated photons, it is a known practice to isolate by various means a solid angle which may or may not be divergent and one section of which contains the emitting focal spot. Said solid angle contains the radiation which is characterized as useful, either because it is particularly monochromatic or because its energy is higher within said angle than at any other location. By reason of the fact that the emissive source is a focal spot of large area, the useful radiation is accordingly made up of two parts:

a primary radiation, a secondary radiation.

A ray forming part of the primary radiation can be defined as a direct ray carried by a straight line which intersects the central axis of the solid angle of the useful radiation at a point which is common to all the primary rays on the central axis of the primary radiation.

A secondary ray is carried by any straight line projected from the emitting focal spot. This radiation is often of low energy relative to the primary radiation, produces images of poor quality in radiology and gives rise to parasitic irradiation in the field of radiation therapy. It is therefore preferable to ensure that this secondary radiation is removed as completely as possible.

Secondary-radiation limiting devices adapted to x-ray tubes have already been proposed in the prior art. These so-called collimating devices in fact select the field of illumination or in other words the solid angle which contains the useful radiation.

French Pat. No. 1,051,495 filed in the name of Compagnie Générale de Radiologie described a collimating device which reduces secondary radiation. But this device consists of a grid or web of conical shape which is directed towards the focal spot. A trace is therefore left in the illuminated field and also absorbs primary radiation. Furthermore, the collimating device is located externally of the x-ray tube at its exit window.

In French Pat. No. 69 09249 published under No. 2,038,757 and filed on Mar. 28th, 1969 in the name of Atome Industriel S.A., there is described a radiation collimator having axial symmetry of revolution directed along the central axis of the useful beam. As seen in cross-section, the collimator is thus a grid and is also located externally of the radiation-generating source.

This external arrangement of the collimator is disadvantageous when it proves necessary to reduce the secondary radiation. In fact, the space located between the focal spot and the entrance of the collimator provides free access to the secondary radiation. In order to overcome this drawback, the present invention proposes to place a secondary-radiation limiter within the x-ray tube in the immediate vicinity of the emitting focal spot.

Furthermore, collimators having a cross-section in the form of a grid or web leave a trace and absorb primary radiation within the field of the useful beam.

In order to remove the above-mentioned disadvantages of the prior art, the aim of the present invention is to provide a secondary-radiation limiter of simple conical shape, one end of which is attached to the exit window of the tube and the other end of which is located in proximity to the radiation-emitting focal spot.

The secondary radiation may not be emitted solely by the focal spot. Said focal spot is in fact a zone bombarded with electrons which are incident upon the anode. A certain quantity of electrons is emitted by the focal spot. These electrons are known as secondary electrons. They are expelled from the focal spot with a certain kinetic energy and are subjected to attraction as a result of the anode potential. They therefore fall back on the anode outside the focal spot with an energy such that said electrons also produce a secondary radiation but this latter is located outside the focal spot and consequently known as extrafocal radiation.

It is also an object of the present invention to absorb this extrafocal radiation.

A more complete understanding of the invention will be gained from the following description of a few x-ray tubes equipped with limiters of this type, reference being made to the accompanying drawings in which.

Figure 1:
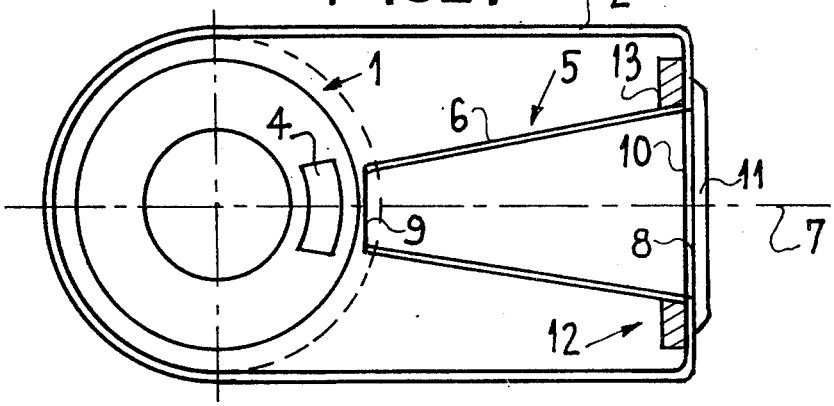
FIG. 1 illustrates a rotating-anode x-ray tube.

FIG. 4, similar to FIG. 1, but illustrates an alternative embodiment of invention.

The examples of construction are more particularly drawn from the field of radiology but also find an application in the field of radiation therapy.

The x-ray tube shown in FIG. 1 comprises a rotating anode 1 included within a vacuum-tight envelope 2. Provision is also made within the interior of said envelope 2 for a photon exciter consisting in this case of an electron gun (not shown in the drawings). The stream of electrons impinges upon the rotating anode 1 at the focal spot 4 which emits the stream of photons.

The secondary-radiation limiter 5 comprises a divergent conical envelope 6 having an axis of symmetry which is aligned with the axis 7 of the selected useful field. Said limiter 5 has an inlet aperture 8 for the photon stream and an outlet aperture 9 for the useful radiation.

The outlet aperture is mechanically attached to the exit window 10 of the tube. Said exit window can be provided with an additional filtration window 11 consisting of a thin sheet of aluminum or of beryllium. This additional filtration has a cumulative effect with the limiter by absorbing the lower-energy rays and therefore reducing the proportion of secondary radiation to an even greater extent with respect to the useful radiation. The means 12 providing a mechanical connection between the outlet aperture 9 and the exit window 10 consist in this case of a ring 13 which is either brazed or welded to a fold of the wall of the envelope 2.

The inlet aperture 8 is placed in the immediate vicinity of the focal spot 4 which emits the stream of photons. The projection of the aperture 8 on the anode 1 can contain or be contained by the surface of the focal spot 4. This characteristic feature can make it possible either to reduce the area of the emitting focal spot or to select a good emission zone of the spot by means of a suitable tube design.

A universal secondary-radiation limiter placed within a discharge tube must satisfy the following three criteria:

the limiter must be capable of absorbing x-ray photons;

it must be electrically insulating;

it must be heat-resistant.

In order to be capable of absorbing x-ray photons, the limiter must consist of a material based on a chemical element having a high atomic number. The material must be electrically insulating in order to ensure that it does not induce potential differences with the anode and therefore modify the field lines within the tube. Said material must also be heat-resistant since it is placed near the focal spot which is a high-temperature source.

The limiter in accordance with the invention is made of material having a base of uranium, hafnium or thorium which correspond to the three requisite properties stated earlier.

The material can be an oxide of the three chemical elements mentioned above. It can also consist of a substrate coated with oxides of this type.

The mechanical connection means comprise a ring 13 formed of an alloy such as, for example, Dilver P or Vacrion 10 in the case of an envelope formed of stainless steel or copper.

Figure 2:
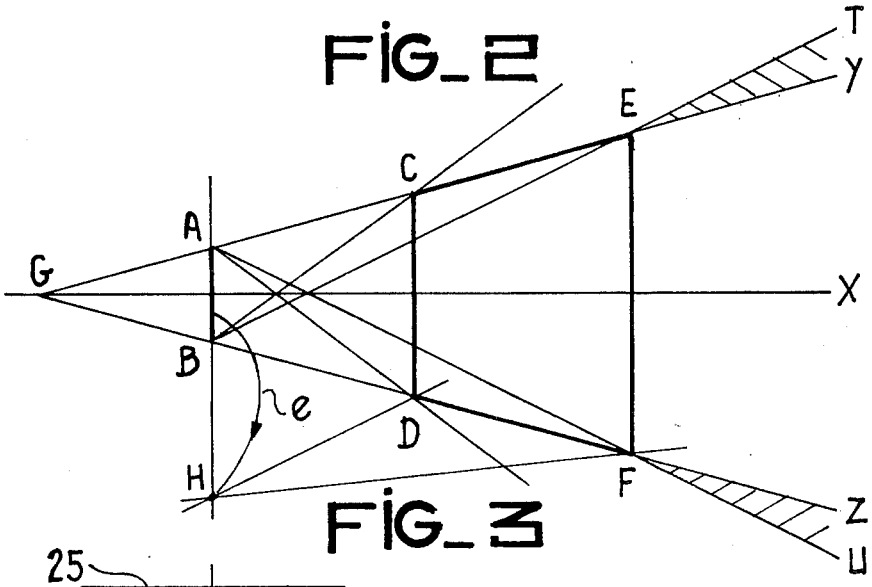
FIG. 2 is an explanatory diagram in which the advantages of the invention will become apparent.

In FIG. 2, there is shown a photon-emitting focal spot AB within the half-space located on the right-hand side of the line which carries the focal spot AB. The median line X is the axis of symmetry of the figure. There is also shown diagrammatically a secondary-radiation limiter CDEF, the inlet and outlet apertures of which are respectively CD and EF.

The primary radiation is included within the space limited by the straight lines GY and GZ, the point G being a point of the axis X of symmetry. A primary ray is therefore defined as a straight line of said space which passes through G. The straight lines GY and GZ are the lines which carry the sides CE and DF of the limiter. They intercept the edges A and B of the focal spot AB in the figure but may also intersect the interior of the focal spot and select a fraction of this latter.

The secondary radiation comprises all the rays carried by the straight lines which are projected from the focal spot AB and do not pass through the point G. If the walls CE and DF have an absorptive capacity for the secondary radiation, the two zones of the space located between on the one hand the straight lines BC and BE and the wall CE and on the other hand the straight lines AD and AF and the wall DF are devoid of any secondary radiation. In contrast, secondary radiation is present in each zone of the space located between on the one hand the straight lines BA and BC and on the other hand the straight lines AB and AD. In order to reduce said secondary radiation, it is necessary to bring the inlet aperture CD of the limiter CDEF closer to the focal spot AB.

This is also the case with the zones limited on the one hand by the straight lines ET and EY and on the other hand by the straight lines FZ and FU as represented by hatched areas in FIG. 2. In order to reduce these zones of secondary radiation, the outlet aperture EF of the limiter in accordance with the invention must be located at a greater distance from the focal spot AB and hence the straight lines ET and FU are brought respectively closer to the straight lines EY and FZ which limit the useful beam.

The extrafocal x-radiation is also considerably reduced. Within the focal spot, an electron is reemitted on the curve e, strikes the target at the point H outside the focal spot. The rays of the sector of the space between the rays HD and HF emitted by the point H, or so-called extrafocal rays, are intercepted and absorbed by the wall DF of the limiter. The displacement of the entrance face CD towards the focal spot AB as well as the enlargement of the limiter on the axis GX make it possible to reduce the proportion of extrafocal radiation within the useful x-ray beam.

Figure 3:
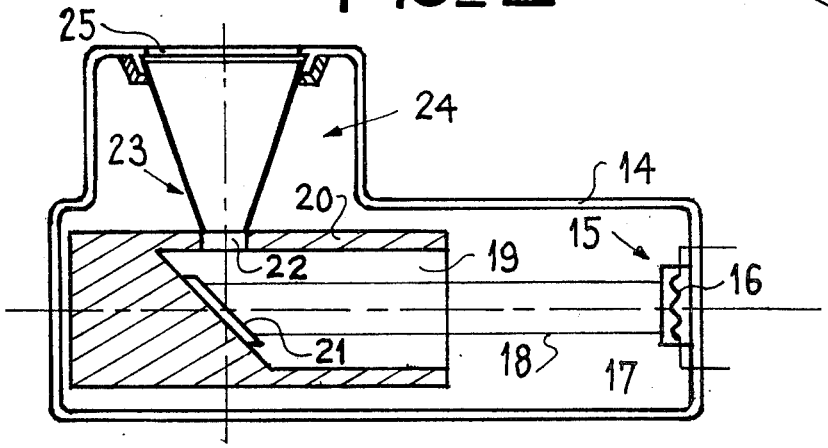
FIG. 3 illustrates a well-type fixed-anode x-ray tube.

FIG. 3 shows a well-type fixed-anode tube. Within the envelope 14, the tube comprises a cathode 15 provided with a filament 16 and with a concentrator 17. An electron beam 18 passes into the well 19 of a fixed anode 20. Said anode comprises a photon-emissive target 21 and is pierced by a radiation exit window 22. A limiter 23 in accordance with the invention is placed within a neck 24 of the tube envelope 14. Its inlet aperture is located opposite to the window 22 of the fixed anode 20 and its outlet aperture is joined to the radiation exit window 25 as indicated earlier. Said exit window may or may not be fitted with an additional filter.

In an arrangement of this type, the well 19 of the anode also contributes to the reduction of secondary radiation. It may therefore prove useful to cover the well 19 externally with a material as described earlier for absorbing the secondary radiation.

An x-ray tube equipped with a secondary-radiation limiter as thus described has the advantage of bringing the emitting focal spot closer to the object under irradiation without calling for the use of an external collimation chamber as described in the prior art. Furthermore, the reduction of the secondary radiation is considerably enhanced by virtue of the displacement of the entrance face of the limiter toward the emitting focal spot.

The emitting focal spot can be constituted by an electron target but also by a target bombarded with incident photons which are caused by the Compton effect to induce another stream of photons within an improved spectral band in accordance with a given emission diagram.

The limiter in accordance with the invention as described is of the divergent type. It is possible as shown in FIG. 4 to design the limiter in the form of a convergent cone 36, in which case the inlet aperture is larger than the outlet aperture without involving any change in the main features of the invention.

The limiter in accordance with the invention can therefore be adapted to any type of small-area focal spot and is thus a universal secondary-radiation limiter.

What is claimed is:

1. A universal limiter for limiting secondary radiation within an x-ray tube comprising an emitting focal spot and an exit window through which a useful beam of radiation passes, wherein said limiter comprises an envelope of predetermined thickness having an axis of symmetry aligned with the central axis of the useful beam of radiation, the inlet aperture of said limiter being located in the immediate vicinity of the emitting focal spot and the outlet aperture of said limiter being joined by connecting means to the exit window through which the useful beam of radiation passes, and wherein said limiter comprises a material which absorbs the secondary radiation and which is electrically insulating.

2. A limiter according to claim 1, wherein said material comprises an oxide of an element having a high atomic number.

3. A limiter according to claim 1, wherein the envelope has a divergent conical shape.

4. A limiter according to claim 1, wherein the connecting means comprise a ring welded to the tube envelope.

5. A limiter according to claim 1, wherein the envelope has a convergent conical shape.

6. A limiter according to claim 2, further comprising a substrate covered with said oxide.

7. A x-ray tube, wherein said tube is provided within the interior of a vacuum-tight envelope with a universal limiter for limiting secondary radiation within an x-ray tube comprising an emitting focal spot and an exit window through which a useful beam of radiation passes, wherein said limiter comprises an envelope of predetermined thickness having an axis of symmetry aligned with the central axis of the useful beam of radiation, the inlet aperture of said limiter being located in the immediate vicinity of the emitting focal spot and the outlet aperture of said limiter being joined by connecting means to the exit window through which the useful beam of radiation passes, and wherein said limiter comprises material which absorbs the secondary radiation and which is electrically insulating.

8. An x-ray tube according to claim 7, wherein the emitting focal spot is of the Compton emission type.

9. An x-ray tube according to claim 7 comprising a fixed-anode provided with a well coated with a material having a high atomic number.

* * * * *